US006276167B1

(12) United States Patent
McCaulley

(10) Patent No.: US 6,276,167 B1
(45) Date of Patent: Aug. 21, 2001

(54) REFRIGERATION PRODUCTION

(75) Inventor: Michael W. McCaulley, Lake Charles, LA (US)

(73) Assignee: Westlake Technology Corporation, Houston, TX (US)

( * ) Notice: Subject to any disclaimer, the term of this patent is extended or adjusted under 35 U.S.C. 154(b) by 0 days.

(21) Appl. No.: 09/276,316

(22) Filed: Mar. 25, 1999

(51) Int. Cl.[7] ..... F25J 3/00
(52) U.S. Cl. ..... 62/619; 62/620
(58) Field of Search ..... 62/619, 631, 620

(56) References Cited

U.S. PATENT DOCUMENTS 4,040,259 * 8/1977 Zahn et al. ..... 62/619
4,710,213 * 12/1987 Sapper et al. ..... 62/631
4,759,786 * 7/1988 Atkinson et al. ..... 62/631
5,505,048 * 4/1996 Ha et al. ..... 62/619

* cited by examiner

*Primary Examiner*—William Doerrler
(74) *Attorney, Agent, or Firm*—Bracewell & Patterson L.L.P.

(57) ABSTRACT

A refrigeration method using a non-aqueous, non-hydrocarbon refrigerant to contact a hydrocarbon composition comprising a hydrocarbon vapor phase and a hydrocarbon liquid phase in order to lower the temperature of the hydrocarbon composition by lowering the partial pressure of the hydrocarbon vapor phase.

30 Claims, 3 Drawing Sheets

REFRIGERATION PRODUCTION

BACKGROUND OF THE INVENTION

1. Field of the Invention

The invention relates broadly to refrigeration and preferably to a refrigeration method using a non-aqueous, non-hydrocarbon refrigerant to contact a hydrocarbon composition as discussed below.

2. Description of Related Art

Common refrigeration systems include vapor compression, fan, heat exchange and absorption systems. Low temperature or cryogenic processes have also become popular, due in part to the increased demand for air liquefaction and separation capacity to make liquid products such as liquid oxygen and liquid nitrogen and also for the low temperature separation of natural gas and natural gas products. Methods typically used to achieve cryogenic temperatures include vaporization of liquids, Joule-Thomson expansion and expansion of gases in an engine doing external work such as a turbo expander.

A mechanical refrigeration cycle is a reversed heat engine system. Generally, vapor compression systems use a pressurized hydrocarbon heat transfer media as a refrigerant. The pressure on the refrigerant is lowered, usually by expansion across a valve. The refrigerant then flows to an evaporator where heat is absorbed, vaporizing the hydrocarbon. The vaporized refrigerant is then compressed and condensed to begin the cycle again. The chemical processing and refining industries are major users of mechanical refrigeration.

Refrigeration is typically used in the chemical processing and refining industries to remove the heat produced by reactions used to make products and to separate components by condensation, distillation or crystallization. Refrigeration systems are also used to process, store and transport perishable foods. Lastly, refrigeration is used to air-condition buildings and cars.

There are many disadvantages associated with current refrigeration designs and methods. Many refrigeration systems are limited by the temperature of the refrigerant. For vapor compression systems, the lowest attainable temperature of the refrigerant is typically determined by its composition, its associated properties and the selected operating pressure. Ambient air conditions, including temperatures and relative humidity, may limit refrigeration produced by air coolers such as fin fans and cooling towers. Absorption systems exhibit another disadvantage similar to that of the vapor compression systems limitations in that the selected operating pressure, e.g., the vacuum, coupled with the brine selection for the absorption system, indirectly result in temperature limits. At higher vacuums, the vaporization temperature drops for a given brine composition. Once the vacuum level is determined, for a given brine composition, the vaporization temperature is established. These temperature limits result in limited refrigeration available, condenser capacity limits and purity limits on products.

Accordingly, a continuing need exists for overcoming these temperature limitations or indirect temperature limitations as reflected by system pressure or ambient conditions. Also, the art has sought a method for refrigeration which does not require the use of excessively large heat exchanger areas or relatively large capacity compressors or vacuum pumps to overcome processing capacity limitations and product purity limitations. Accordingly, the present invention relates to a method of improved refrigeration which may result in reduced energy costs by lowering reflux requirements, by improving separation, and by decreasing or eliminating flooding in distillation columns. In another aspect of the invention, lowered energy requirements for reboiling distillation columns may result from increasing vaporization of light hydrocarbons by introducing a non-hydrocarbon vapor to a hydrocarbon liquid phase, lowering the temperature of the liquid and vapor and reducing light hydrocarbon losses, particularly of ethane or ethylene.

SUMMARY OF THE INVENTION

In one aspect, the invention involves a refrigeration method comprising lowering the temperature of a hydrocarbon composition by lowering the partial pressure exerted by the hydrocarbon vapor phase. The partial pressure of the hydrocarbon vapor phase is preferably lowered by introducing a non-aqueous, non-hydrocarbon refrigerant into the system, preferably at a fixed pressure as generally established or held by a pressure controller, although floating or variable pressure control schemes may also be employed with this invention.

A specific embodiment of the invention involves a refrigeration method, comprising the steps of: introducing at least one hydrocarbon composition into a phase separator, such that the hydrocarbon composition comprises one or more hydrocarbons and includes at least a hydrocarbon liquid phase and a hydrocarbon vapor phase in the phase separator; contacting the hydrocarbon liquid phase with a non-aqueous, non-hydrocarbon refrigerant, the refrigerant being in an amount sufficient to lower the partial pressure of the hydrocarbon vapor phase and to vaporize at least a part of the hydrocarbon liquid phase and to lower the temperature of the hydrocarbon composition by at least about 1° C.; removing at least one hydrocarbon product from the phase separator, such that the hydrocarbon product includes at least a part of the hydrocarbon liquid phase or at least a part of hydrocarbon vapor phase.

Another aspect of the present refrigeration method may comprise the steps of introducing at least one hydrocarbon composition into a phase separator, such that the hydrocarbon composition comprises one or more hydrocarbons and includes at least a hydrocarbon liquid phase and a hydrocarbon vapor phase in the phase separator; contacting the hydrocarbon liquid phase with a non-aqueous, non-hydrocarbon refrigerant, the refrigerant being in an amount sufficient to lower the partial pressure of the hydrocarbon vapor phase and to vaporize at least a part of the hydrocarbon liquid phase and to lower the temperature of the hydrocarbon composition by at least about 1° C.; removing at least a part of the hydrocarbon liquid phase from the phase separator; and removing at least a part of the hydrocarbon vapor phase from the phase separator.

A preferred embodiment of the refrigeration method comprises the steps of introducing at least one hydrocarbon composition into a phase separator, such that the hydrocarbon composition comprises one or more hydrocarbons and includes at least a hydrocarbon liquid phase and a hydrocarbon vapor phase the phase separator having at least one inlet location and a plurality of outlet locations, an interior including mass transfer apparatus and a lower end and an upper end, the lower end of the phase separator and at least a part of the mass transfer apparatus supporting hydrocarbon composition; contacting the hydrocarbon liquid phase with a non-aqueous, non-hydrocarbon refrigerant, the refrigerant being in an amount sufficient to lower the partial pressure of the hydrocarbon vapor phase; vaporizing at least a part of the hydrocarbon liquid phase; lowering the temperature of the hydrocarbon composition by at least about 1° C.; evaporating a portion of the hydrocarbon liquid phase supported by mass transfer media forming a hydrocarbon vapor phase; condensing a portion of the hydrocarbon vapor phase; separating heavy hydrocarbon constituents from the hydrocarbon vapor phase; separating light hydrocarbon constituents from the hydrocarbon liquid phase; removing a vapor product from the upper end of the distillation column; and removing a liquid product from the lower end of the distillation column.

In another preferred embodiment, the phase separator is a reflux drum which provides a cold reflux stream to a distillation column. The method of this preferred embodiment of the invention comprises introducing at least one hydrocarbon composition into a reflux drum such that the hydrocarbon composition comprises one or more hydrocarbons and includes at least a hydrocarbon liquid phase and a hydrocarbon vapor phase; contacting the hydrocarbon liquid phase with a non-aqueous, non-hydrocarbon refrigerant, the refrigerant being in an amount sufficient to lower the partial pressure of the hydrocarbon vapor phase and to vaporize at least a part of the hydrocarbon liquid phase and to lower the temperature of the hydrocarbon composition by at least about 1° C.; removing a vapor product containing at least a part of the refrigerant from the reflux drum; removing from the reflux drum at least a part of the hydrocarbon liquid phase to provide a reflux stream; and directing the reflux stream to a distillation column. Preferably, the temperature of the hydrocarbon composition is lowered by at least about 5° C.

Another feature of the present invention is that the refrigerant may be introduced directly to the hydrocarbon vapor space in the phase separator, the phase separator containing a hydrocarbon composition comprising one or more hydrocarbons and having at least a hydrocarbon liquid phase and a hydrocarbon vapor phase which preferably occupies some or all of the vapor space; introducing a non-aqueous, non-hydrocarbon refrigerant into the vapor space of the phase separator; contacting the hydrocarbon liquid phase with the refrigerant, the refrigerant being in an amount sufficient to lower the partial pressure of the hydrocarbon vapor phase and to vaporize at least a part of the hydrocarbon liquid phase and to lower the temperature of the hydrocarbon constituent by at least about 1° C.; removing at least one hydrocarbon product, such that the hydrocarbon product includes at least a part of the hydrocarbon liquid phase or at least a part of the hydrocarbon vapor phase. Another feature of the present invention is that the contacting of the hydrocarbon liquid phase may preferably comprise the step of bubbling the refrigerant through the hydrocarbon liquid phase.

A further feature of the method of this invention is that the method may be used with either batch processes or continuous processes. The method may also be used in a discontinuous or intermittent manner, for example, to overcome condenser capacity problems in the summer when condenser duty may be limited by the ambient temperatures. Another example of intermittent use would be to use the method in treating an off-specification hydrocarbon feed or product, containing excessive light constituents, by inducing vaporization of light constituents in the hydrocarbon phase. In accordance with this aspect of the present invention, the method may also include the step of introducing a hydrocarbon composition feed to the phase separator which is either an intermittent or a continuous hydrocarbon composition feed.

An additional feature of the present invention is that the phase separator may be a reboiler, a reflux drum, a refrigerant accumulator, a heat exchanger, a flash drum, or a distillation column. Also accordance with this aspect of the present invention, the distillation column may preferably be a demethanizer, ethylene fractionator, deethanizer, depropanizer, propane fractionator, debutanizer, butane fractionator or other distillation column. An additional feature of this aspect of the present invention may include using a hydrocarbon composition comprising a light hydrocarbon fraction selected from the group consisting of $C_1$ to $C_6$ hydrocarbons or mixtures thereof.

Another feature of the present invention may include the step of reclaiming at least a part of the refrigerant from the vapor product as a reclaimed refrigerant. The method may also include the step of recycling some or all of the reclaimed refrigerant wherein at least a part of the reclaimed refrigerant is recycled back to the phase separator. As the temperature of the hydrocarbon liquid phase becomes lower, a further feature of the present invention may also include the step of recovering additional refrigeration or cooling from the hydrocarbon liquid phase, the hydrocarbon vapor phase, the recovered refrigerant or any combination of the three. The lower equilibrium temperature of the reclaimed refrigerant produced by using this inventive refrigeration method results in a greater temperature difference for indirect heat exchange operations. The step of recovering additional refrigeration, or cooling may include the step of using the reclaimed refrigerant to transfer sensible heat from another process stream to the hydrocarbon liquid phase or the hydrocarbon vapor phase wherein the process stream has a temperature above the minimum approach temperature for the heat exchanger configuration. Optionally, the lower temperature produced by the refrigeration method may provide a large enough approach temperature to allow for indirect heat exchange opportunities that were previously infeasible. In accordance with these aspects of the present invention, the heat exchange may be performed in any conventional heat transfer apparatus, for example, in a shell and tube exchanger, double pipe exchanger or a plate fin exchanger.

In accordance with another aspect, a method of the present invention includes admixing a hydrocarbon composition, such that the hydrocarbon composition comprises one or more hydrocarbons and include at least a hydrocarbon liquid phase and a hydrocarbon vapor phase and a non-aqueous, non-hydrocarbon refrigerant to form a feed stream to a phase separator, the phase separator having at least one feed location and an upper and a lower end; introducing the feed stream into at least one feed location and to vaporize at least a part of the feed stream including at least a part of the non-aqueous, non-hydrocarbon refrigerant to form a vapor product and to lower the temperature of the hydrocarbon composition by at least about 1° C.; removing the vapor product from the upper end of the phase separator and removing a liquid product from the lower end of the phase separator. An additional feature of this aspect of the present invention is that the phase separator may be a reboiler, a reflux drum, a flash drum, a refrigerant accumulator, or a distillation column. A further feature of this aspect of the present invention includes the additional step of reclaiming at least a part of the refrigerant from the vapor product as a reclaimed refrigerant. An additional step of recycling the reclaimed refrigerant may be used, wherein at least a part of the reclaimed refrigerant is recycled to the phase separator. In order to reduce energy costs, the method may also include the additional step of recovering refrigeration, or cooling by transfer of sensible heat from another process stream to the hydrocarbon liquid phase, the hydrocarbon vapor phases or the reclaimed refrigerant by heat exchanging the hydrocarbon liquid phase, the hydrocarbon vapor phase, or the reclaimed refrigerant with a process stream having a temperature above the minimum approach temperature for the heat exchanger configuration allowing the transfer of sensible heat from the process stream. In accordance with this aspect of the present invention, the heat exchange may be performed in any conventional heat transfer apparatus, for example, in a shell and tube exchanger, a double pipe exchanger or a plate fin exchanger.

The refrigeration method may also comprise the steps of introducing at least one hydrocarbon composition into a reflux drum, such that the hydrocarbon composition comprises one or more hydrocarbons and includes at least a hydrocarbon liquid phase and a hydrocarbon vapor phase; contacting the hydrocarbon liquid phase with a non-aqueous, non-hydrocarbon refrigerant, the refrigerant being in an amount sufficient to lower the partial pressure of the hydrocarbon vapor phase and to vaporize at least a part of the hydrocarbon liquid phase and to lower the temperature of the hydrocarbon composition by at least about 1° C.; removing a vapor product containing at least a part of the refrigerant from the reflux drum; removing at least a part of the hydrocarbon liquid phase from the reflux drum; and directing the reflux stream to a distillation column. As the method of the present invention results in a lower equilibrium temperature for both the hydrocarbon liquid and vapor phases, the refrigeration method may further comprise the step of recovering additional refrigeration or cooling from at least a part of the vapor product or at least a part of the hydrocarbon liquid phase. The lower equilibrium temperature results in a greater temperature difference for current indirect heat exchange operations. Alternatively, the lower temperature produced by the refrigeration method may provide a large enough approach temperature to allow for indirect heat exchange opportunities that were previously infeasible. Another feature of this aspect of the present invention may also comprise of the steps of expanding the vapor product to produce a low pressure vapor product and recovering refrigeration from either the vapor product or the low pressure vapor product, or both.

The refrigeration method may also comprise the steps of introducing at least one hydrocarbon composition into a reboiler such that the hydrocarbon composition comprises one or more hydrocarbons and includes at least a hydrocarbon liquid phase and a hydrocarbon vapor phase; contacting the hydrocarbon liquid phase with a non-aqueous, non-hydrocarbon refrigerant, the refrigerant being in an amount sufficient to lower the partial pressure of the hydrocarbon vapor phase and to vaporize at least a part of the hydrocarbon liquid phase and to lower the temperature of the hydrocarbon composition by at least about 1° C.; removing a reboiled stream containing at least a part of the refrigerant wherein at least a part of the reboiled stream is returned to a distillation column to provide stripping vapors. A further feature of this aspect may include utilizing a reboiler stream that is a vapor phase, such as produced by a kettle reboiler, or a mixed liquid and vapor phase such as produced by a thermosiphon reboiler.

In accordance with another aspect of the present invention, the refrigeration method may be utilized with a vapor compression refrigeration system using a hydrocarbon based heat transfer media. The foregoing advantages may be achieved by the present invention by producing refrigeration within the vapor compression refrigeration system which may comprise the steps of introducing at least one hydrocarbon composition into a refrigerant accumulator, such that the hydrocarbon composition comprises one or more hydrocarbons and includes at least a hydrocarbon liquid phase and a hydrocarbon vapor phase; contacting the hydrocarbon liquid phase with a non-aqueous, non-hydrocarbon refrigerant, the refrigerant being in an amount sufficient to lower the partial pressure of the hydrocarbon vapor phase and to vaporize at least a part of the hydrocarbon liquid phase and to lower the temperature of the hydrocarbon composition by at least about 1° C.; removing a vent gas from the refrigerant accumulator; and removing a liquid refrigerant supply from the refrigerant accumulator.

The method of the present invention may also be utilized in flash operations and may comprise the following steps of introducing at least one hydrocarbon composition into a flash drum, such that the hydrocarbon composition comprises one or more hydrocarbons and includes at least a hydrocarbon liquid phase and a hydrocarbon vapor phase; contacting the hydrocarbon liquid phase with a refrigerant comprising a non-aqueous, non-hydrocarbon constituent, the refrigerant being in an amount sufficient to lower the partial pressure of the hydrocarbon vapor phase and to vaporize at least a part of the hydrocarbon liquid phase and to lower the temperature of the hydrocarbon constituent by at least about 1° C.; separating light hydrocarbon constituents from the hydrocarbon liquid phase; removing a vapor product from the flash drum; and removing a liquid product from the flash drum.

BRIEF DESCRIPTION OF THE DRAWINGS

In the drawings, the methods of the present invention are illustrated by means of simplified flow diagrams and simplified block flow diagrams in which such details as pumps, instrumentation, valves, piping networks, heat-recovery circuits, compressors and similar hardware have been deleted as unnecessary to an understanding of the process involved. Identical reference numerals may be used for identical components and reference numerals following by an alpha notation may be utilized for components similar to those components previously described.

Figure 1:
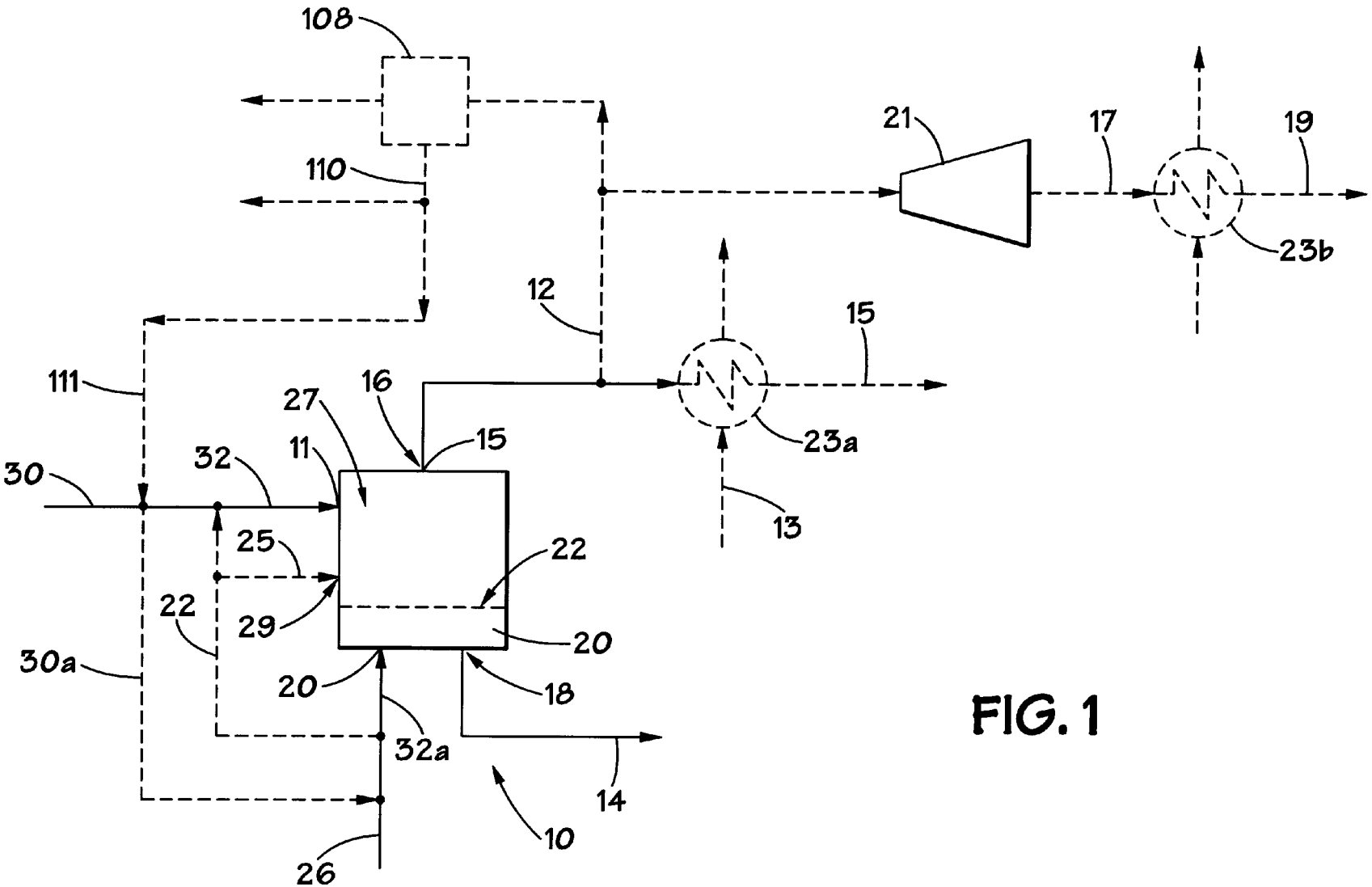
FIG. 1 is a simplified block flow diagram of a phase separator in accordance with the present invention, such as may be used in a commercial chemical plant or refinery, depicting different addition points for the refrigerant.

While the invention will be described in connection with the preferred embodiments and examples, it will be understood that it is not intended to limit the invention to those embodiments. On the contrary, the invention is intended to cover all alternatives, modifications, and equivalents as defined by the appended claims.

DETAILED DESCRIPTION

For purposes of this invention, the term "refrigerant" refers to any non-aqueous, non-hydrocarbon composition that is capable of lowering the partial pressure of the hydrocarbon composition and preferably exists in at least a partially vaporized state at the pressure and temperature existing in the phase separator containing the hydrocarbon composition when the refrigerant initially contacts the hydrocarbon liquid phase in the phase separator or while the temperature of the hydrocarbon liquid phase is being reduced. Preferably, the refrigerant is a gas, i.e., fully vaporized, at 25° C. and 760 mm of Hg. More preferably, the refrigerant is a gas having a low molecular weight of less than about 71. Still more preferably, the refrigerant may be selected from the group consisting of molecular hydrogen ($H_2$), molecular nitrogen ($N_2$), molecular oxygen ($O_2$) ammonia ($NH_3$) carbon dioxide ($CO_2$) carbon monoxide (CO), helium (He), hydrogen sulfide ($H_2S$), sulfur dioxide ($SO_2$) molecular chlorine ($Cl_2$), air and mixtures thereof.

The refrigerant of this invention is preferably substantially non-reactive with the hydrocarbon composition, meaning that while it may be to some extent reactive with the hydrocarbon composition, it should not produce an excessive amount of reactive by-products, i.e., no more than about 1% and preferably no more than about 5% and more preferably no more than about 10% by weight of the hydrocarbon composition. Thus, for example, while air containing nitrogen and reactive oxygen may be used in some situations, it should not be used if it reacts with the hydrocarbon composition to form undesirable by-products to the extent that removal of those by-products becomes necessary. Explosive limits should be avoided when utilizing air or oxygen to avoid personal injury and property damage, e.g., any vapor mixtures should be too lean or too rich to explode or deflagrate. In a preferred aspect, the refrigerant is an inert gas, preferably molecular nitrogen ($N_2$), i.e., totally non-reactive. In another preferred aspect, the refrigerant is hydrogen.

The refrigerant must be both non-aqueous and non-hydrocarbon. Aqueous-based refrigerants including steam are not acceptable in the method of the invention because of the tendency for water to contaminate the hydrocarbon composition, promote emulsions and create waste disposal problems. Furthermore, in cryogenic processes, water may result in hydrate formation and associated process plugging or freezing problems. Also, hydrocarbon refrigerants may not be used in the refrigeration method of this invention. The inventor has discovered that hydrocarbons tend to not lower the partial pressure exerted by the hydrocarbon vapor phase, nor induce vaporization of the hydrocarbon liquid phase. However, the refrigerant may be mixed with trace amounts of water or with hydrocarbons. For example, it is contemplated that water in the amount of 10 wt % or less (based on refrigerant) may be present in the refrigerant. The amount of hydrocarbon mixed in the refrigerant need not be limited so long as sufficient refrigerant is supplied to lower the temperature of the hydrocarbon liquid phase by at least about 1° C. For example, in one preferred embodiment, hydrocarbons and the refrigerant are mixed to form a feed stream for processing in a phase separator.

The term "phase separator" as used herein means a vessel wherein the hydrocarbon composition forms or exists as at least one hydrocarbon liquid phase and one hydrocarbon vapor phase and may include multiple liquid phases, solid phases, and vapor phases. A chemical reactor is not considered a "phase separator" as used herein, although reactions of a minor nature may occur in the phase separator, e.g., less than 5% cracking or saturation of the hydrocarbon composition.

Upon the refrigerant contacting the hydrocarbon liquid phase, the partial pressure of the hydrocarbon vapor phase is lowered by the refrigerant. However, the saturation pressure of the hydrocarbon composition preferably remains substantially constant while the refrigerant is in contact with the hydrocarbon composition. Therefore, vaporization of the hydrocarbon liquid phase is induced by the lower hydrocarbon vapor phase partial pressure. A new equilibrium may be established at a lower temperature, assuming the system pressure is not increased. If the system pressure is increased, the volatilization of the lighter constituents of the hydrocarbon liquid phase will be reduced.

With reference to FIG. 1, a method of refrigeration, which is a specific embodiment of this invention, will be described. The phase separator 10 may generally have multiple inlet and outlet locations. One inlet location 24 is preferably at the lower end of the phase separator 18 for the addition of the refrigerant 26 to facilitate contacting of the refrigerant through the hydrocarbon liquid phase. Alternatively, the refrigerant 26 may be admixed with an alternative hydrocarbon feed 30(*a*), as shown by the broken line, and introduced to the phase separator 10 through a location 24. The refrigerant 28 may be optionally admixed with hydrocarbon feed 30, forming a feed stream 32 introduced to the phase separator 10 at inlet location 11. The refrigerant 26 may also be contacted with the liquid phase of the hydrocarbon composition 20 using a mass transfer medium in the interior of the phase separator 10. Alternatively, the refrigerant 25 may be fed directly into the vapor space 27 of the phase separator 10 through an upper inlet location 29, as shown by the broken line. The inlet location 29, in relation to the outlet 16, should be located such that the refrigerant 25 physically contacts the liquid phase of the hydrocarbon composition 20 and does not "blow by" or channel through the phase separator 10. Channeling problems may be identified using a gamma scan similar to those done on distillation columns. After entering the phase separator 10, the refrigerant 25, 26, or 28 and the feed streams 32 or 32*a* should be partially vaporized so that at least a part of at least one of the refrigerant 25, 26, 28 and a part of the hydrocarbon stream 30 or 32*a* will form a vapor product 12 which will exit the upper end of the phase separator 16. A liquid product 14 may be recovered from at least a part of the hydrocarbon liquid phase from the phase separator 10 at the lower end of the phase separator 18.

Still with reference to FIG. 1, the present invention includes a method of producing refrigeration by introducing a refrigerant 26, or optionally, multiple refrigerant feeds 25, 26, 28, into the liquid phase of a hydrocarbon composition 20 and separating or flashing a vapor product 12 from the mixture of any of the hydrocarbon feeds 30, 32a and any of the refrigerants 25, 26, 28. The amount of refrigerant 25, 26, 28 added to the phase separator 10 must be sufficient to lower the partial pressure of the hydrocarbon vapor phase in the vapor space 27 and vaporize at least a part of the hydrocarbon liquid phase 20 and lower the temperature of the hydrocarbon composition, preferably by at least about 1° C. Even more preferably, the temperature of the hydrocarbon constituent is lowered by at least about 5° C.

In a preferred embodiment, at least a part of the vapor product 12 is indirectly heat exchanged in a conventional heat exchange apparatus 23*a* such as a shell and tube exchanger or a plate fin exchanger with a process stream 13 having a temperature that is greater than the minimum approached temperature with a heat exchanger configuration. In still another preferred embodiment, the refrigerant may be reclaimed from using a gas separation process 108, e.g., selective membrane separation technology, metal hydride absorption, water washing, recompression and heat exchange, or other gas separation processes. The reclaimed refrigerant 110 may be utilized elsewhere or may be recycled to the phase separator 10 as a reclaimed refrigerant 111, 30*a*. In still another preferred embodiment, the vapor product 12 may be expanded to further cool the vapor phase. This may be done as a Joule-Thompson expansion or preferably the expansion may take place in an engine doing external work such as a turbo expander 21. The expanded vapor product 17 may provide further refrigeration or cooling by using a heat exchanger 23*b* to provide cooling to a process stream having a minimum approach temperature that is greater the minimum approach temperature for the heat exchanger configuration.

With respect to FIG. 2, a refrigeration method in accordance with the present invention will be described. The distillation column 10*d* has an upper end 16*d* and a lower end 18*d*, the lower end 18*d* adapted to contain a liquid phase of a hydrocarbon composition 20*d*. At least one feed location 21*a*, or preferably a plurality feed locations 21*a*, 21*b*, 21*c*, may be used to introduce the column hydrocarbon feed 36 or column hydrocarbon feeds 34, 36, 71 to the distillation column 10*d* at an appropriate location. At least one location 24*d* for removing a liquid bottoms product 54 should be located in the lower end 18*d* of the distillation column 10*d* and at least one outlet location 8 should be located in the upper end 16*d* of the distillation column 10*d* for removing an overhead vapor 62. The interior of the distillation column 31 may include conventional mass transfer apparatus such as fractionation trays, structured packing, dumped packing, or other mass transfer apparatus (not shown). Optionally, multiple products may be removed from the distillation column 10*d* as side draw products 112, 114, for example.

Figure 2:
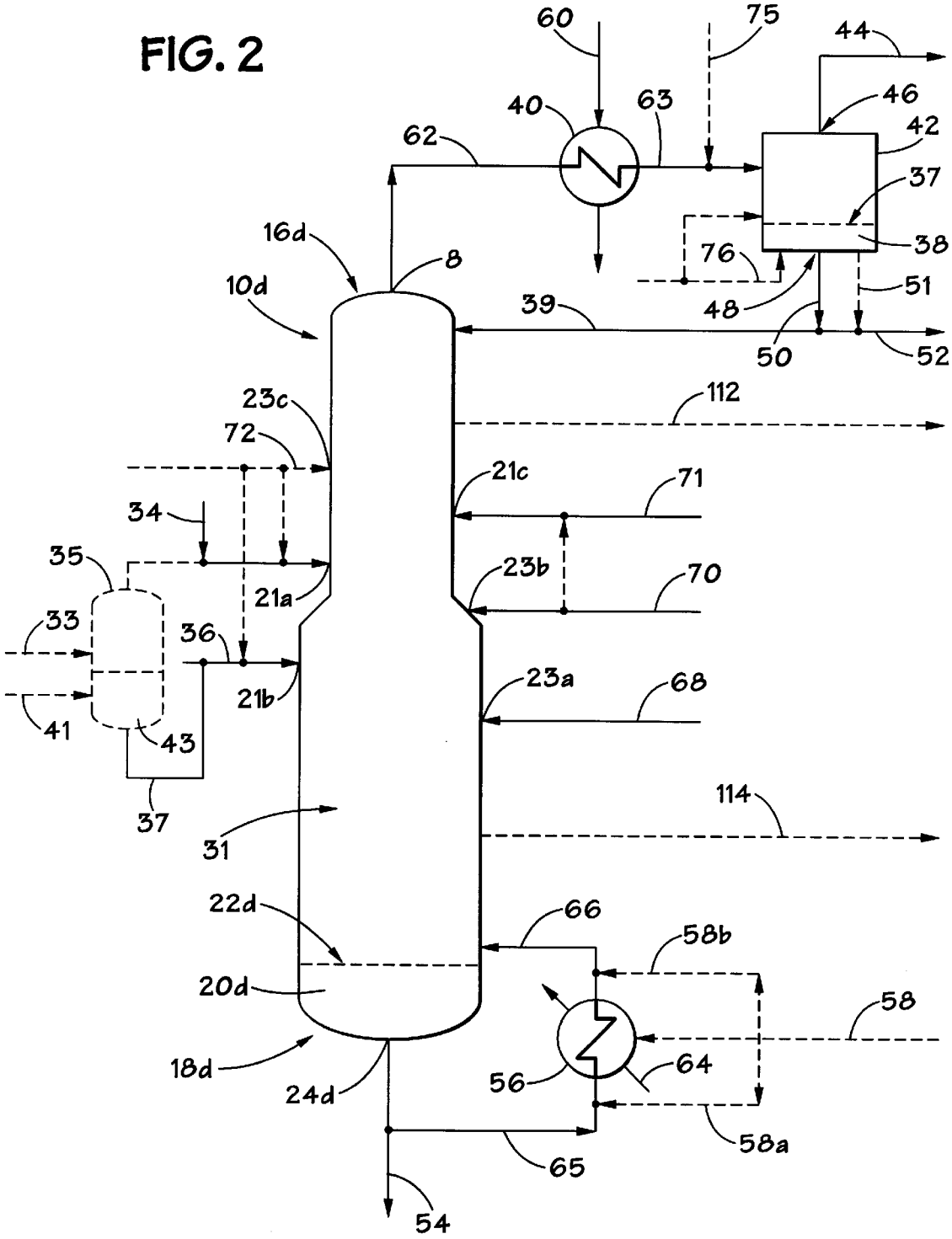
FIG. 2 is a simplified flow diagram of a distillation column in accordance with the present invention, such as may be used in a commercial chemical plant or refinery for the separation of hydrocarbon constituents, showing addition points for the refrigerant to the column, the reboiler and the reflux drum.

Still with reference to FIG. 2, the means for producing an overhead liquid 38 for use as reflux 39 and a liquid product stream 52 by distilling the column hydrocarbon feed 36, or column hydrocarbon feeds 34, 36, 71 may include an overhead condenser 40 to cool the overhead vapor 62 and a reflux drum 42 to collect the overhead liquid 38. A cooling media 60 may be used in the condenser 40 to indirectly heat exchange with the overhead product 62 to produce a condensed liquid 63. Optionally, a partial condenser may be used wherein the condensed liquid 63 also includes associated vapor. The cooling media 60 supplied may be cooling water or another process stream which may be indirectly heat exchanged in a conventional heat exchanger arrangement such as shell and tube, double pipe or plate fin exchangers. Optionally, air coolers such as fin fans may be used as the condenser 40 wherein the cooling medium 60 is ambient air. Condensed liquid 63, with associated vapor, if any, produced by the overhead condenser 40 flows into the reflux drum 42 whereby the liquid is separated from any associated vapor and exits the reflux drum 42 at the reflux drum lower end 48. Overhead product vapor 44 may exit the reflux drum 42 at its upper end 46. The overhead liquid 38 in the reflux drum 42 may be split into an overhead liquid product stream 52 and a reflux stream 39 for contacting stripping vapors rising through the distillation column 10*d* and for condensing relatively heavy components from the vapor and forming a downwardly flowing liquid or internal reflux. Inside the distillation column 10*d*, the internal reflux contacts the rising stripping vapors using the mass transfer apparatus to intimately mix the rising stripping vapors and falling liquid or internal reflux comprising a hydrocarbon composition. A liquid phase 20*d* distilled from the hydrocarbon composition comprising the column hydrocarbon feeds 34, 36, 71 and located in the lower end 18*d* of the distillation column 10*d* may be withdrawn from the lower end 18*d* of the distillation column 10*d* as a liquid bottoms product 54. A part of a liquid bottoms product 54, may be used as a reboiler liquid 65, which may be heated in the reboiler 56 by hot process stream 64. The reboiler may be any suitable heat transfer apparatus but is preferably a Thermosiphon or a kettle reboiler. The reboiled liquid 66 is returned to the distillation column 10*d* to produce stripping vapors to contact the internal reflux.

Still with reference to FIG. 2, a refrigeration method in a distillation column 10*d* will be described. A refrigerant 68 or a plurality of refrigerant streams 68, 70, 72 may be introduced to the distillation column 10*d* through a plurality of feed locations as represented by 23*a*, 23*b*, 23*c*. At least a part of the refrigerant streams 68, 70, 72 will vaporize producing rising vapors for contacting a liquid phase of the hydrocarbon composition which forms an internal reflux, and which simultaneously flows downwardly within distillation column 10*d* wherein the internal reflux, the rising vapors, both refrigerant vapors and hydrocarbon vapors are intimately mixed on the mass transfer apparatus, effecting the distillation process. The introduction of the refrigerant into the distillation column 10*d* lowers the partial pressure of the hydrocarbon composition in the vapor phase. The lowered partial pressure of the hydrocarbon vapor phase induces the vaporization of lighter hydrocarbon constituents as it re-establishes vapor-liquid equilibrium.

This induced vaporization produces a refrigeration effect. The refrigeration effect may be used to produce a cooler reflux which results in a lower reflux flow rate requirement to effect the same separation in the distillation column. Optionally, the cooler reflux may be used to increase the quality of the separation in the distillation column. If it is chosen to operate the distillation column at a lower reflux flow rate, then the distillation column 10*d* can be operated with a lower reboiler duty to achieve the same vaporization rate. This results in lower vapor and liquid traffic, because stripping vapors and internal reflux rates are reduced in the internal part of the column 31. The reduced vapor and liquid traffic allows the distillation column 10*d* to be operated optionally at a lower pressure, taking advantage of improved separation values, otherwise known as K-values. The improved K-values in turn allows still lower reboiler and condenser duty requirements to produce the same separation in the distillation column.

In some instances the reduced vapor and liquid traffic may obviate flooding conditions wherein the column vapor and liquid traffic are so high that the desired separation cannot be effected. Where flooding conditions are removed, the efficiency of the distillation column is greatly increased. Alternatively, capacity increases may also result where flooding conditions in distillation columns are lowered by the present refrigeration method.

Optionally, the refrigerant streams 68, 70, 72 may be admixed with the column hydrocarbon feeds 34, 36, 71, for example, as illustrated in FIG. 2, by the admixing of the refrigerant 72 with the column hydrocarbon feed 34, 36, or as illustrated by admixing the refrigerant stream 70 with column hydrocarbon feed 71 before introduction into the distillation column 10*d*.

The improved refrigeration method may include introducing a refrigerant 58*a* into a reboiler liquid 65 or by introducing a refrigerant 58*b* to a reboiled liquid 66. Preferably, the refrigerant 58 may be introduced directly into the reboiler 56, for example, when the reboiler is a kettle. As previously described, the refrigerant lowers the partial pressure exerted by the vapor phase of the hydrocarbon composition. The lowered partial pressure of the vapor phase of the hydrocarbon composition induces further vaporization of the various hydrocarbon constituents. Advantageously, this vaporization is induced without any increase in the reboiler duty, i.e., the need of the reboiler 58 to supply additional heat. The induced vaporization also facilitates the removal of lighter hydrocarbon constituents from the reboiled liquid 66. Thus, reboiler duties may be lowered to achieve the same vaporization rate.

The present refrigerant method may also involve introducing the refrigerant into a hydrocarbon system to produce refrigeration in the reflux drum 42. Preferably, non-aqueous, non-hydrocarbon refrigerant 76 is bubbled through a quantity of overhead liquid 38 in order to reduce the partial pressure of the hydrocarbon vapor phase and to induce additional vaporization of the lighter hydrocarbon constituents. Alternatively, the refrigerant may be introduced into the vapor space of the reflux drum 37 to induce vaporization of the lighter hydrocarbon constituents. This induced vaporization produces a refrigeration effect which lowers the temperature of the reflux stream 39 being returned to the distillation column 10*d* by at least about 1° C., preferably by at least about 5° C. In addition, the refrigeration may increase the concentration of the lightest components in the overhead vapor product 44, thereby increasing the recovery of the heavier hydrocarbon components in the overhead liquid product stream 52. The relatively colder reflux 39 also results in reduced vapor and liquid traffic, and lower pressure drop across the distillation column. The operating pressure of the distillation column 10*d* may also be reduced, resulting in improved K-values, component separation, possibly saving energy costs. Alternatively, the refrigerant 75 may be admixed with a condensed liquid 63 from the overhead condenser, before introduction into the reflux drum 42.

The present refrigeration method may also be used in a flash operation. As illustrated in FIG. 2, the flash operation may be a part of the feed preparation to a distillation column, or it may be incorporated into other processing methods. A hydrocarbon flash feed 33 may be of a liquid phase, multiple liquid phases, a vapor phase, or combination thereof. The hydrocarbon flash feed 33 may be introduced to a flash drum 35 in order to separate volatile light hydrocarbon constituents from heavy hydrocarbon liquid constituents. A refrigerant 41 may be introduced and preferably bubbled through the liquid phase of the hydrocarbon composition which forms a flash drum liquid 43. Alternatively, the refrigerant 41 may contact the liquid phase of the hydrocarbon composition following introduction into the vapor space of the flash drum 35. As previously described, the refrigerant lowers the partial pressure of the hydrocarbon vapor phase and induces volatilization of light hydrocarbon constituents. The flashed vapor product 34 taken overhead from the flash drum 35 may be introduced as a column feed to a point relatively high in a distillation column 10*d* as compared to the remaining liquid 37 from the flashed hydrocarbon composition 43 separated in the flash drum 35. The induced vaporization of light hydrocarbon constituents produces a refrigeration effect which results in a cooler equilibrium temperature for the flash operation.

Figure 3:
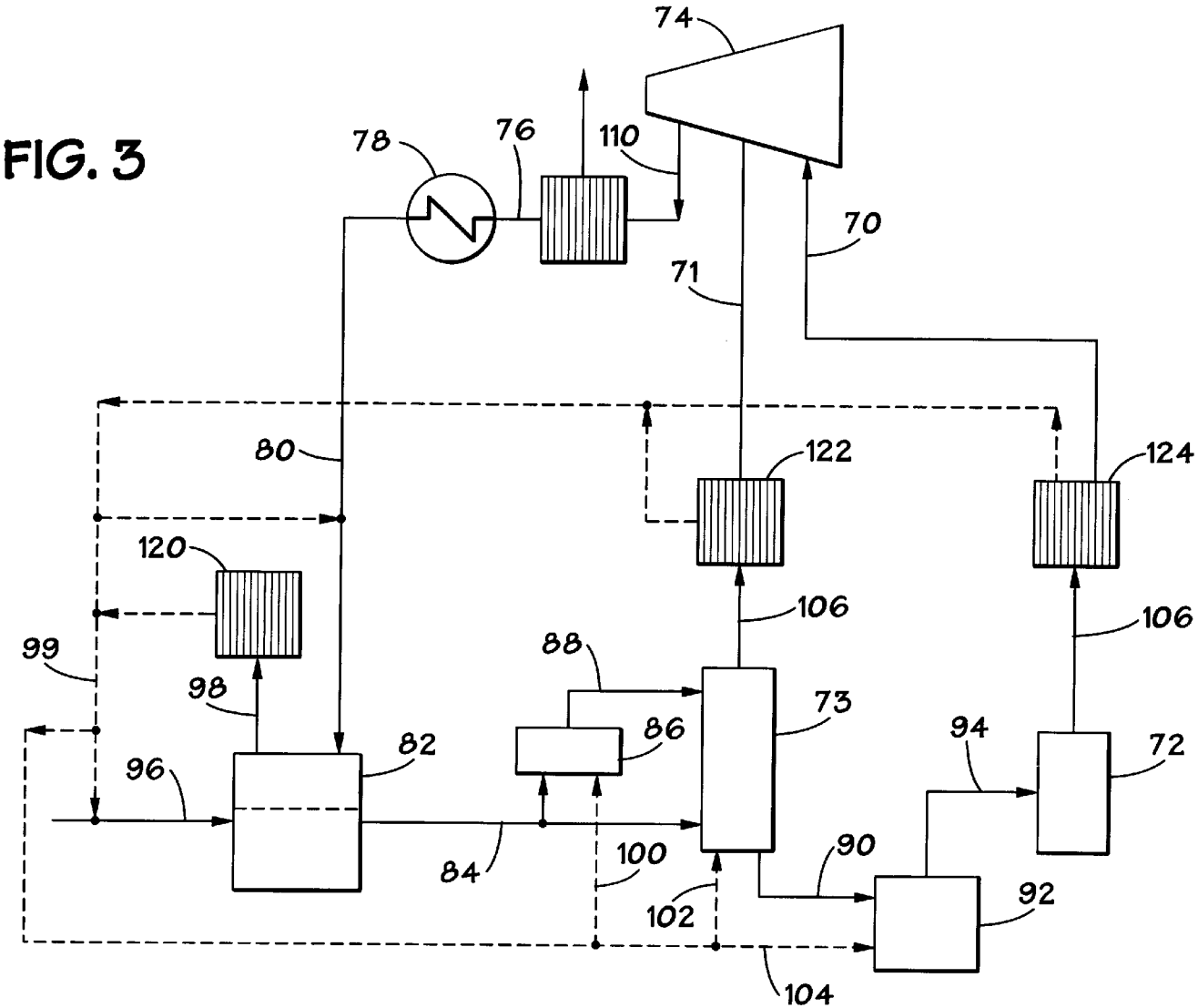
FIG. 3 is a simplified block flow diagram of a vapor compression refrigeration system in accordance with the present invention such as may be used in a commercial chemical plant or refinery, showing addition points for the refrigerant.

With reference to FIG. 3, the refrigeration method of the present invention can be used to augment a conventional chiller network that utilizes hydrocarbon based heat transfer media. Compressed heat transfer media vapors 76 flow to the heat transfer media condenser 78 where the vapors are cooled and condensed to produce a liquefied heat transfer media 80. The liquefied heat transfer media 80 flows to the refrigerant accumulator 82. The refrigerant accumulator 82 maintains a supply of liquid heat transfer media 80 for use by heat exchangers generally referred to as chillers 86, 92, or respectively, as a high temperature chiller 86 and a low temperature 92 chiller. The pressure in the refrigerant accumulator 82 is maintained at a higher pressure than the chillers 86, 92 and the pressure in the high temperature chiller 86 is normally maintained at a higher pressure than that in the low temperature chiller 92. The high pressure heat transfer media supply 84 flows to a high temperature chiller 86.

A non-aqueous, non-hydrocarbon refrigerant 96 may be introduced into the refrigerant accumulator 82 producing a refrigeration effect. The refrigerant 96 lowers the partial pressure of the hydrocarbon vapor phase inside the refrigerant accumulator 82 thereby inducing the hydrocarbon liquid phase to further evaporate. The evaporation cools the hydrocarbon liquid phase and lowers the temperature of the high pressure refrigeration supply 84 by at least about 1° C., preferably by about 5° C. Thus, refrigeration capacity may be increased. This is particularly advantageous where low temperature constraints set refrigeration capacity. The non-aqueous, non-hydrocarbon refrigerant 96 may be introduced similarly to successive refrigerant accumulators where multiple refrigerant accumulators, including those operating at differing pressures are utilized.

Vent gas 98 from the refrigerant accumulator 82 may be processed by conventional gas separation processes 120, 122, 124, such as selective membrane separation technology, metal hydride absorption, water washing, or recompression and heat exchange, depending upon the non-aqueous, non-hydrocarbon constituent selected for the refrigerant 96. The reclaimed refrigerant 99 may then be recycled to the refrigerant accumulator 82 or other refrigerant addition points, as shown by the non-aqueous, non-hydrocarbon refrigerant streams, 100, 102, and 104 in FIG. 3. The other possible refrigerant addition points may include the high temperature chiller 86 as shown by refrigerant stream 100, the high pressure phase separator 73 shown by refrigerant stream 102 or lower temperature chiller 92 as shown by non-hydrocarbon feed 104. Optionally, high pressure off gas 106 or low pressure off gas 108 may be fed to a gas separation process 122, 124 as previously described. Alternatively, a gas separation process may be located between the compressor 126 and the heat transfer media condenser 78.

EXAMPLES

Example 1

Table 1 shows the results of a computer process simulation of one embodiment of the invention shown in FIG. 1. A hydrocarbon composition represented by hydrocarbon feed 30 is admixed with a non-aqueous, non-hydrocarbon refrigerant 28 to form a feed stream 32 which is introduced to the phase separator 10 at inlet location 11. The feed stream 32 is partially vaporized, including at least a part of the non-aqueous, non-hydrocarbon refrigerant to form a vapor product 12 while lowering the temperature of the hydrocarbon composition by at least about 15° C. The vapor product 12 is removed from the upper end of the phase separator 16 and a liquid product 14 is removed from the lower end of the phase separator. The stream numbers recited in Table 1 coincide with those of FIG. 1. In this particular embodiment, the phase separator 10 is a reflux drum to a demethanizer.

TABLE 1

| Stream No. Description | 30 Hydrocarbon Feed | 28 Refrigerant | 32 Feed Stream | 14 Liquid Product | 12 Vapor Product |
|---|---|---|---|---|---|
| | | | Invention | | |
| Vapour Frac. | 0.5008 | 1.0000 | 0.8969 | 0.0000 | 1.0000 |
| Temp. (° F.) | −148.4250 | −148.6840 | −176.2015 | −176.2015 | −176.2015 |
| Pressure (psig) | 473.0000 | 473.0000 | 473.0000 | 473.0000 | 473.0000 |
| Molar Flow (lbmole/hr) | 1083.0190 | 1782.1599 | 2865.1788 | 295.4534 | 2569.7256 |
| Mass Flow (Mlb/hr)* | 16.5292 | 6.2102 | 22.7395 | 6.3930 | 16.3465 |
| Liq. Vol. Flow (USGPM) | 112.4861 | 111.8515 | 224.3376 | 37.0810 | 187.2567 |
| Enthalpy (Btu/hr) | 459378.3162 | 3.12257E+06 | 3.58194E+06 | −620069.7451 | 4.20201E+06 |
| Density (lb/ft3) | 4.7808 | 0.5119 | 1.4888 | 29.5844 | 1.0856 |
| Mole Wt. | 15.2622 | 3.4847 | 7.9365 | 21.6379 | 6.3612 |
| Spec. Heat (Btu/lb-° F.) | 0.8638 | 1.9185 | 1.0286 | 0.6746 | 1.1670 |
| Thermal Cond. (Btu/hr-ft-° F.) | | 0.0572 | | 0.0910 | 0.0388 |
| Viscosity (cP) | | 0.0060 | | 0.1042 | 0.0065 |
| Z Factor | | 0.9948 | | 0.1173 | 0.9394 |
| Surface Tension (dyne/cm) | | | | 10.8690 | |
| Std. Density (lb/ft3) | | | | | |
| Hydrogen (mole fraction) | 0.1833 | 0.9062 | 0.6330 | 0.0201 | 0.7034 |
| CO (mole fraction) | 0.0002 | 0.0002 | 0.0002 | 0.0001 | 0.0002 |
| Methane (mole fraction) | 0.6684 | 0.0812 | 0.3031 | 0.4938 | 0.2812 |
| Acetylene (mole fraction) | 0.0006 | 0.0000 | 0.0002 | 0.0019 | 0.0000 |
| Ethylene (mole fraction) | 0.1423 | 0.0116 | 0.0610 | 0.4626 | 0.0148 |
| Ethane (mole fraction) | 0.0052 | 0.0008 | 0.0025 | 0.0215 | 0.0003 |

Example 2

Table 2 shows the results of a computer process simulation of a comparative example. In the comparative example, no refrigerant is used as shown by the zero (0.0) molar flow in 1bmoles/hr. The hydrocarbon feed's 30 composition, temperature pressure and flow are identical to that of Example 1. The temperature of the liquid product 14 and vapor product 16 in the comparative example is −148.4° F. The temperature difference between the inventive and comparative example demonstrates a 27.7° F., or (15.4° C.) cooling effect from using the non-aqueous, non-hydrocarbon refrigerant.

TABLE 2

| Stream No. Description | 30 Hydrocarbon Feed | 28 Refrigerant | 32 Feed Stream | 14 Liquid Product | 12 Vapor Product |
|---|---|---|---|---|---|
| | | | Comparative | | |
| Vapour Frac. | 0.5008 | 1.0000 | 0.5008 | 0.0000 | 1.0000 |
| Temp. (° F.) | −148.4250 | −148.6840 | −148.4251 | −148.4251 | −148.4251 |
| Pressure (psig) | 473.0000 | 473.0000 | 473.0000 | 473.0000 | 473.0000 |
| Molar Flow (lbmole/hr) | 1083.0190 | 0.0000 | 1083.0190 | 540.6008 | 542.4182 |
| Mass Flow (Mlb/hr)* | 16.5292 | 0.0000 | 16.5292 | 10.2883 | 6.2410 |

TABLE 2-continued

| | Comparative | | | | |
|---|---|---|---|---|---|
| Stream No. Description | 30 Hydrocarbon Feed | 28 Refrigerant | 32 Feed Stream | 14 Liquid Product | 12 Vapor Product |
| Liq. Vol. Flow (USGPM) | 112.4861 | 0.0000 | 112.4861 | 63.1604 | 49.3257 |
| Enthalpy (Btu/hr) | 459378.3162 | 0.0000 | 459378.3162 | −554957.3825 | 1.01433E+06 |
| Density (lb/ft3) | 4.7808 | 0.5119 | 4.7808 | 24.3058 | 2.0569 |
| Mole Wt. | 15.2622 | 3.4847 | 15.2622 | 19.0312 | 11.5058 |
| Spec. Heat (Btu/lb-° F.) | 0.8638 | 1.9185 | 0.8638 | 0.8847 | 0.8293 |
| Thermal Cond. (Btu/hr-ft-° F.) | | 0.0572 | | 0.0689 | 0.0241 |
| Viscosity (cP) | | 0.0061 | | 0.0595 | 0.0081 |
| Z Factor | | 0.9948 | | 0.1143 | 0.8168 |
| Surface Tension (dyne/cm) | | | | 5.5364 | |
| Std. Density (lb/ft3) | | | | | |
| Hydrogen (mole fraction) | 0.1833 | 0.9062 | 0.1833 | 0.0179 | 0.3482 |
| CO (mole fraction) | 0.0002 | 0.0002 | 0.0002 | 0.0001 | 0.0003 |
| Methane (mole fraction) | 0.6684 | 0.0812 | 0.6684 | 0.7139 | 0.6229 |
| Acetylene (mole fraction) | 0.0006 | 0.0000 | 0.0006 | 0.0011 | 0.0001 |
| Ethylene (mole fraction) | 0.1423 | 0.0116 | 0.1423 | 0.2571 | 0.0279 |
| Ethane (mole fraction) | 0.0052 | 0.0008 | 0.0052 | 0.0099 | 0.0005 |

What is claimed is:

1. A refrigeration method, comprising the steps of:

(a) introducing at least one hydrocarbon composition into a phase separator, such that the hydrocarbon composition comprises one or more hydrocarbons and includes at least a hydrocarbon liquid phase having a first pressure and a hydrocarbon vapor phase in the phase separator;

(b) contacting the hydrocarbon liquid phase with a non-aqueous, non-hydrocarbon refrigerant while maintaining said liquid phase at said first pressure, the refrigerant being in an amount sufficient to lower the partial pressure of the hydrocarbon vapor phase and to vaporize at least a part of the hydrocarbon liquid phase and to lower the temperature of the hydrocarbon composition by at least 1 C; and (c) removing at least one hydrocarbon product, such that the hydrocarbon product includes at least a part of the hydrocarbon liquid phase or at least a part of the hydrocarbon vapor phase.

2. A refrigeration method comprising the steps of:

(a) introducing at least one hydrocarbon composition into a phase separator, such that the hydrocarbon composition comprises one or more hydrocarbons and includes at least a hydrocarbon liquid phase having a first pressure and a hydrocarbon vapor phase in the phase separator having at least one inlet location and a plurality of outlet locations, an interior including mass transfer apparatus and a lower end and an upper end, the lower end of the phase separator and at least a part of the mass transfer apparatus supporting a hydrocarbon composition;

(b) contacting the hydrocarbon liquid phase with a non-aqueous, non-hydrocarbon refrigerant while maintaining said liquid phase at said first pressure, the refrigerant being in an amount sufficient to lower the partial pressure of the hydrocarbon vapor phase and to vaporize at least a part of the hydrocarbon liquid phase and to lower the temperature of the hydrocarbon composition by at least 1 C;

(c) evaporating a portion of the hydrocarbon liquid phase supported by the mass transfer apparatus forming a hydrocarbon vapor phase;

(d) condensing a portion of the hydrocarbon vapor phase;

(e) separating heavy hydrocarbon constituents from the hydrocarbon vapor phase;

(f) separating light hydrocarbon constituents from the hydrocarbon liquid phase;

(g) removing a vapor product from the upper end of the mass transfer apparatus; and (h) removing a liquid product from the lower end of the mass transfer apparatus.

3. The method of claim 1, wherein the step of removing at least one hydrocarbon product includes at least a part of the hydrocarbon liquid phase and at least or part of the hydrocarbon vapor phase.

4. The method of claim 1, wherein the step of contacting the hydrocarbon liquid phase comprises bubbling the refrigerant through the hydrocarbon liquid phase.

5. The method of claim 1, wherein the step of contacting the hydrocarbon liquid phase comprises introducing the refrigerant into the hydrocarbon vapor phase in the phase separator.

6. The method of claim 1, wherein the refrigerant consists essentially of hydrogen.

7. The method of claim 1, further comprising the step of reclaiming at least a part of the refrigerant from at least one hydrocarbon product as a reclaimed refrigerant.

8. The method of claim 7, further comprising the step of recycling the reclaimed refrigerant, wherein at least a part of the reclaimed refrigerant is recycled to the phase separator.

9. The method of claim 8, further comprising the step of utilizing the reclaimed refrigerant to provide additional refrigeration by heat exchanging the reclaimed refrigerant indirectly with a process stream having a temperature above the minimum approach temperature for the heat exchanger configuration.

10. The method of claim 9, wherein the step of heat exchanging is performed in a shell and tube exchanger.

11. The method of claim 9, wherein the step of heat exchanging is performed in a plate fin exchanger.

12. The method of claim 1, wherein the phase separator is a reboiler, a reflux drum, a refrigerant accumulator, a heat exchanger, a flash drum, or a distillation column.

13. The method of claim 12, wherein the distillation column is a demethanizer, ethylene fractionator, deethanizer, depropanizer, propane fractionator, debutanizer or butane fractionator.

14. The method of claim 13, wherein the hydrocarbon composition comprises a light hydrocarbon fraction selected from the group consisting of $C_1$ to $C_6$ hydrocarbons or mixtures thereof.

15. The method of claim 1, wherein the step of lowering the temperature of the hydrocarbon composition is by at least 5° C.

16. A refrigeration method, comprising the steps of:

(a) admixing a hydrocarbon composition, such that the hydrocarbon composition comprises one or more hydrocarbons and includes at least a hydrocarbon liquid phase having a first pressure and a hydrocarbon vapor phase and a non-aqueous, non-hydrocarbon refrigerant, while maintaining said liquid phase at said first pressure, to form a feed stream to a phase separator, the phase separator having at least one feed location, an upper end and a lower end;

(b) introducing the feed stream into the at least one feed location and to vaporize at least a part of the feed stream including at least a part of the non-aqueous, non-hydrocarbon refrigerant to form a vapor product and to lower the temperature of the hydrocarbon composition by at least 1 C;

(c) removing the vapor product from the upper end of the phase separator; and (d) removing a liquid product from the lower end of the phase separator.

17. The method of claim 16, wherein the phase separator is a reboiler, reflux drum, a flash drum, a refrigerant accumulator, or a distillation column.

18. The method of claim 16, further comprising the step of reclaiming at least a part of the refrigerant from the vapor product as a reclaimed refrigerant.

19. The method of claim 16, further comprising the step of recycling the reclaimed refrigerant, wherein at least a part of the reclaimed refrigerant is recycled to the phase separator.

20. The method of claim 17, further comprising the step of recovering refrigeration from the reclaimed refrigerant by heat exchanging the reclaimed refrigerant indirectly with a process stream having a temperature above the minimum approach temperature for the heat exchanger configuration.

21. The method of claim 20, wherein the indirect heat exchange is performed in a shell and tube exchanger.

22. The method of claim 21, wherein the indirect heat exchange is performed in a plate fin exchanger.

23. A method of refrigeration comprising the steps of:

(a) introducing at least one hydrocarbon composition into a reflux drum, such that the hydrocarbon composition comprises one or more hydrocarbons and includes at least a hydrocarbon liquid phase having a first pressure and a hydrocarbon vapor phase;

(b) contacting the hydrocarbon liquid phase with a non-aqueous, non-hydrocarbon refrigerant while maintaining said liquid phase at said first pressure, the refrigerant being in an amount sufficient to lower the partial pressure of the hydrocarbon vapor phase and to vaporize at least a part of the hydrocarbon liquid phase and to lower the temperature of the hydrocarbon composition by at least 1 C;

(c) removing a vapor product containing at least a part of the refrigerant from the reflux drum;

(d) removing at least a part of the hydrocarbon liquid phase from the reflux drum as a reflux stream; and (e) directing the reflux stream to a distillation column.

24. The method of claim 23, further comprising the additional step of recovering refrigeration from at least a part of the vapor product or at least a part of the hydrocarbon liquid phase by indirect heat exchange.

25. The method of claim 23, further comprising the steps of expanding at least a part of the vapor product to produce a low pressure vapor product and recovering refrigeration from at least a part of the vapor product or low pressure vapor product or both by indirect heat exchange.

26. A refrigeration method comprising the steps of:

(a) introducing at least one hydrocarbon composition into a reboiler, such that the hydrocarbon composition comprises one or more hydrocarbons and includes at least a hydrocarbon liquid phase having a first pressure and a hydrocarbon vapor phase;

(b) contacting the hydrocarbon liquid phase with a non-aqueous, non-hydrocarbon refrigerant while maintaining said liquid phase as said first pressure, the refrigerant being in an amount sufficient to lower the partial pressure of the hydrocarbon vapor phase and to vaporize at least a part of the hydrocarbon liquid phase and to lower the temperature of the hydrocarbon composition by at least 1 C; and (c) removing a reboiled stream containing at least a part of the refrigerant wherein at least a part of the reboiled stream is returned to a distillation column to provide stripping vapors.

27. The method of claim 26 wherein the reboiled stream returned to the distillation column is in a vapor phase.

28. The method of claim 27, is a mixed liquid and vapor phase.

29. A refrigeration method comprising the steps of:

(a) introducing at least one hydrocarbon composition into a refrigerant accumulator, such that the hydrocarbon composition comprises one or more hydrocarbons and includes at least a hydrocarbon liquid phase having a first pressure and a hydrocarbon vapor phase a quantity of hydrocarbon liquid;

(b) contacting the hydrocarbon liquid phase with a non-aqueous, non-hydrocarbon refrigerant while maintaining said liquid phase at said first pressure, the refrigerant being in an amount sufficient to lower the partial pressure of the hydrocarbon vapor phase and to vaporize at least a part of the hydrocarbon liquid phase and to lower the temperature of the hydrocarbon constituent by at least 1 C;

(c) removing a vent gas from the refrigerant accumulator; and (d) removing a liquid refrigerant supply from the refrigerant accumulator.

30. A refrigeration method comprising the steps of:

(a) introducing at least one hydrocarbon composition into a flash drum, such that the hydrocarbon composition comprises one or more hydrocarbons and includes at least a hydrocarbon liquid phase having a first pressure and a hydrocarbon vapor phase;

(b) contacting the hydrocarbon liquid phase with a non-aqueous, non-hydrocarbon refrigerant while maintaining said liquid phase at said first pressure, the refrigerant being in an amount sufficient to lower the partial pressure of the hydrocarbon vapor phase and to vaporize at least a part of the hydrocarbon liquid phase and to lower the temperature of the hydrocarbon composition by at least 1 C;

(c) separating light hydrocarbon constituents from the hydrocarbon liquid phase;

(d) removing a vapor product from the flash drum; and (e) removing a liquid product from the flash drum.

* * * * *